US006945358B2

(12) United States Patent
Albano

(10) Patent No.: US 6,945,358 B2
(45) **Date of Patent: *Sep. 20, 2005**

(54) SUSPENDED SCAFFOLDING SYSTEM

(76) Inventor: James R. Albano, 975 Linda Vista Dr., San Marcos, CA (US) 92069

( * ) Notice: Subject to any disclaimer, the term of this patent is extended or adjusted under 35 U.S.C. 154(b) by 0 days.

This patent is subject to a terminal disclaimer.

(21) Appl. No.: 10/776,436

(22) Filed: Feb. 10, 2004

(65) Prior Publication Data

US 2004/0159491 A1 Aug. 19, 2004

Related U.S. Application Data

(63) Continuation of application No. 10/066,313, filed on Feb. 1, 2002, now Pat. No. 6,722,468.

(51) Int. Cl.[7] ..... E04G 3/00; E04G 3/10
(52) U.S. Cl. ..... 182/82; 182/150
(58) Field of Search ..... 182/82, 150, 45, 182/113, 106; 248/235, 214, 250

(56) References Cited

U.S. PATENT DOCUMENTS 4,276,957 A * 7/1981 Kilgore ..... 182/150
5,503,358 A * 4/1996 Lapp ..... 248/235
5,582,376 A * 12/1996 Thompson ..... 248/214
5,829,549 A * 11/1998 Flynn ..... 182/82
6,003,631 A * 12/1999 Knauth ..... 182/82
6,039,150 A * 3/2000 Palmer ..... 182/113

* cited by examiner

*Primary Examiner*—Hugh B. Thompson, II
(74) *Attorney, Agent, or Firm*—Luce, Forward, Hamilton & Scripps, LLP

(57) ABSTRACT

A suspended scaffolding system and method of use employs a plurality of scaffolding brackets that are hung from the framework of a building under construction to support a plurality of scaffolding planks to form a walkway therebetween. The scaffolding brackets include an anchor assembly, which is specially designed to wrap around the building's framework such that construction workers can complete their work without removing the brackets.

21 Claims, 2 Drawing Sheets

SUSPENDED SCAFFOLDING SYSTEM

CROSS REFERENCE TO RELATED APPLICATIONS

This application is a continuation of U.S. application No. 10/066,313, filed Feb. 1, 2002, now U.S. Pat. No. 6,722,468.

FIELD OF THE INVENTION

The present invention is directed to scaffolding systems, and more particularly to a suspended scaffolding system that is securely attached to a building under construction.

BACKGROUND OF THE INVENTION

During construction of a building, workers frequently assemble scaffolding to allow an elevated platform from which to work on higher portions of the building. Conventional scaffolding systems consist of a number of sections that are based on the ground and stacked to build up to a desired height. However, these systems suffer from a number of disadvantages. For example, typical scaffolding systems are difficult to assemble and transport because they are heavy and cumbersome. In light of these disadvantages, suspended or portable scaffolding systems have been developed.

Suspended scaffolding systems are usually attached directly to the building under construction and, therefore, do not require leveling according to ground conditions. In addition, suspended scaffolding systems are lighter and much easier to assemble and transport than conventional scaffolding systems. However, these suspended systems suffer from a number of disadvantages as well. For example, some suspended scaffolding systems require expensive anchor assemblies to be installed on the building structure. Other suspended scaffolding systems utilize support brackets that block access to portions of the building's infrastructure such that the job cannot be completed until the scaffolding system is disassembled.

Therefore, there exists a need for a suspended scaffolding system that requires minimal assembly time and does not interfere with completion of construction of the building.

To the extent that specific publications are discussed above, these discussions should not be taken as an admission that the discussed publications (e.g., patents) are prior art for patent law purposes. For example, some or all of the discussed publications may not be sufficiently early in time and/or sufficiently enabling so as to amount to prior art for patent law purposes.

SUMMARY OF THE INVENTION

At least some embodiments of the present invention may exhibit one or more of the following objects, advantages and benefits:

One aspect of the present invention involves a suspended scaffolding bracket for a building under construction, comprising a vertical support, a horizontal support and an anchor assembly structured to fit about a crossbeam of the building such that construction work adjacent the crossbeam can be completed without removing the scaffolding bracket.

Another aspect of the present invention involves a suspended scaffolding bracket for a building under construction, comprising a vertical support, a horizontal support and an anchor assembly; wherein the anchor assembly includes a vertical plate and a horizontal plate structured to fit across only a portion of the top surface of the crossbeam.

A further aspect of the present invention involves a suspended scaffolding bracket for a building under construction, comprising a vertical support, a horizontal support, and a brace member for receiving a cross-support, wherein the cross-support is structured to span at least three studs of the building under construction.

Another aspect of the present invention involves a suspended scaffolding bracket for a building under construction, comprising a vertical support, a horizontal support and an anchor assembly structured to fit about a crossbeam of the building, wherein the anchor assembly includes a vertical plate and a horizontal plate dimensioned to extend across only a portion of a top surface of the crossbeam in a direction from the inside surface of the crossbeam toward an outside surface of the crossbeam, whereby a leading edge of the top surface of the crossbeam is unobstructed and a freeze block can be installed in contact with the leading edge without removing the bracket.

Yet another aspect of the present invention involves a suspended scaffolding system for a building under construction, comprising a plurality of scaffolding brackets, each bracket comprising a vertical support, a horizontal support, and an anchor assembly structured to fit about a crossbeam of the building such that construction work adjacent the crossbeam can be completed without removing the scaffolding bracket; and a plurality of scaffolding planks spanning the plurality of scaffolding brackets to form a walkway.

An additional aspect of the present invention involves a suspended scaffolding system for a building under construction, comprising a plurality of scaffolding brackets, each bracket comprising a vertical support, a horizontal support, and an anchor assembly; and a plurality of scaffolding planks spanning the plurality of scaffolding brackets to form a walkway, wherein each horizontal plate is structured fit across only a portion of the top surface of a crossbeam.

A further aspect of the present invention involves a method of installing a suspended scaffolding system around a building under construction, including the steps of: providing a plurality of scaffolding brackets, each scaffolding bracket including a horizontal support, a vertical support, and an anchor assembly structured to fit about a crossbeam of the building under construction; and maneuvering each scaffolding bracket such that each anchor assembly is positioned across upper and inner surfaces of a crossbeam of the building under construction, wherein each anchor assembly includes a horizontal plate structured to fit across only a portion of the upper surface of the crossbeam.

DETAILED DESCRIPTION OF THE PREFERRED EMBODIMENTS

Figure 1:
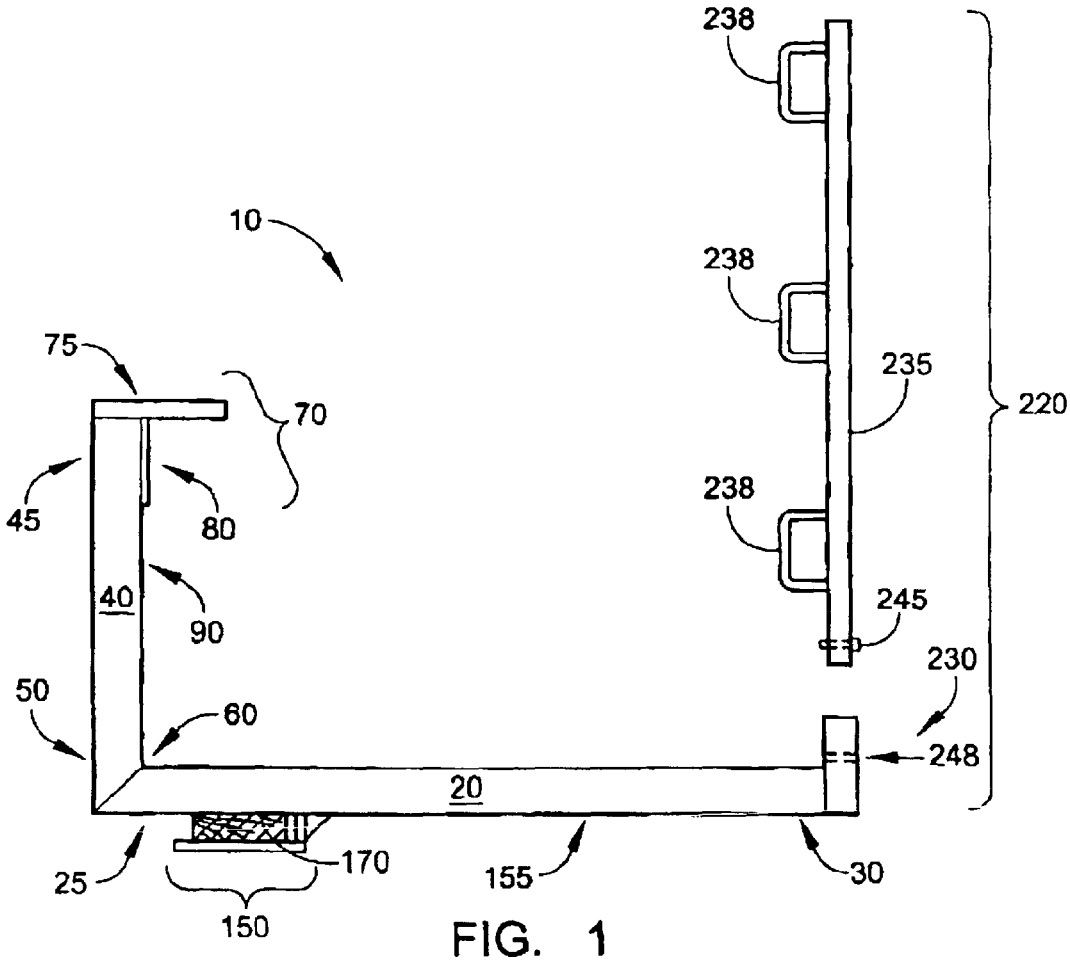
FIG. 1 is a side view of an exemplary embodiment of a suspended scaffolding bracket for use in a suspended scaffolding system for a building under construction according to the present invention.

Before starting a description of the Figures, instructions for interpreting the words and phrases of this patent document will be provided. More particularly, many jurisdictions allow a patentee to act as its own lexicographer, and thereby allow the patentee to provide instructions in a patent document as to how the words, terms and phrases of the document are to be interpreted as a legal matter. For example, in the United States, the prerogative of the patentee to act as its own lexicographer has been solidly established based on statutory and case law. Accordingly, the following section provides rules for interpreting the words, terms and phrases the claims of this patent document.

Interpretive Rules

Rule 1: There is a "Specially Defined Terms" section set forth below. Only words, terms or phrases that are explicitly defined in the Specially Defined Terms are to be considered to have a special definition, and, of course, the explicit definition provided herein is to serve as the definition for these terms. Accordingly, sources such as the patent specification and extrinsic evidence shall not be used to help define these terms—the explicitly provided definitions shall control.

Rule 2: If a word, term or phrase is not specially defined, then its definition shall be determined in the first instance by resort to dictionaries and technical lexicons that either exist as of the time this patent document is filed. (See definition of "dictionaries and technical lexicons" below in the Specially defined Terms section.) It is acknowledged that dictionaries and technical lexicons often provide alternative definitions. Also, definitions provided in different dictionaries and different lexicons often differ and are not always entirely consistent. In that case, it must be decided which definition is in best accordance with this document. Rules 3 and 4, set forth below, provide some guidelines for choosing between alternative definitions for a word, term or phrase.

Rule 3: The role of the specification (other than the Specially Defined Terms section) as an interpretive or definitional aid shall be limited to helping choose between alternative definitions that meet the requirements of Rule 2 (above). However, the specification will only be useful when the specification is more consistent with one proposed, pre-existing definition than another.

Rule 4: The role of extrinsic evidence (e.g., expert witnesses) as an interpretive of definitional aid shall be limited to helping choose between alternative definitions that meet the requirements of Rule 2 (above). However, the extrinsic evidence will only be useful when the extrinsic evidence is more consistent with one proposed, pre-existing definition than another.

Specially Defined Terms the present invention: means at least some embodiments of the present invention; references to various feature(s) of the "present invention" throughout this document do not mean that all claimed embodiments or methods include the referenced feature(s).

structured to: this phrase is used in the claims to indicate that some thing X is "structured to" perform some objective Y. This means that X must have appropriate structure to meet the objective Y that occurs after the "structured to" language. It does not mean that the possible structures for X are limited to what is shown in the specification, but rather includes any and all X, now conventional or to be developed in the future, wherein the structure of X allows the X to perform objective Y. (Note that X and Y are used as variables in this definition of "structured to;" in the claims, various things may be recited as the X variable for purposes of applying this definition, and various objectives maybe recited as the Y variable.)

comprising . . . a; comprising . . . one; comprising . . . x: comprising means including; for example, if a claim recites that an assembly "comprising a" widget, then the claim should be construed to cover assemblies that have one widget or more than one widget; the fact that the assembly includes a widget does not mean that covered assemblies are limited to one widget unless such a limitation is explicitly present in the claim.

dictionaries and/or technical lexicons: any document whose primary purpose is the definition of words, terms and/or phrases; on the other hand, documents that merely discuss, explain or provide examples of devices or methods, without purporting to provide definitions of specific words, phrases or terms, are not to be considered as dictionaries and/or technical lexicons.

To the extent that the definitions provided above are consistent with ordinary, plain and accustomed meanings (as generally evidenced, inter alia, by dictionaries and/or technical lexicons), the above definitions shall be considered supplemental in nature. To the extent that the definitions provided above are inconsistent with ordinary, plain and accustomed meanings (as generally evidenced, inter alia, by dictionaries and/or technical lexicons), the above definitions shall control. If the definitions provided above are broader than the ordinary, plain and accustomed meanings in some aspect, then the above definitions will control at least in relation to their broadening aspects.

Preferred Embodiment(s)

The present invention discloses a suspended scaffolding system, which employs a plurality of scaffolding brackets that are hung from the framework of a building under construction. These scaffolding brackets are specially designed to wrap around the building's framework such that construction workers can complete their work without removing the brackets. Like conventional scaffolding brackets, the brackets of the present invention are used to support a plurality of scaffolding planks to form a walkway therebetween.

FIG. 1 depicts an exemplary embodiment of a suspended scaffolding bracket 10 for use in a suspended scaffolding system for a building 15 under construction. As best seen in FIG. 1, the scaffolding bracket 10 includes a horizontal support 20 having a first end 25 and a second end 30, and a vertical support 40 having a top end 45 and a bottom end 50. The supports 20,40 preferably consist of square steel tubing connected at elbow joint 60 by welding or by fasteners such as bolts or rivets. As one of ordinary skill in the art can appreciate, the tubing may be another shape such as circular and the material may be an alternative to steel such as aluminum without departing from the scope of the invention.

Figure 2:
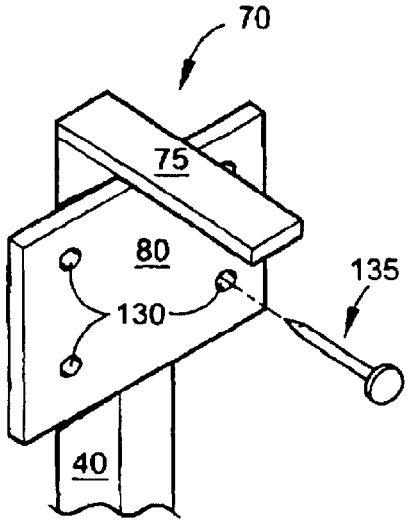
FIG. 2 is a perspective view of an exemplary embodiment of an anchor assembly for a suspended scaffolding bracket according to the present invention.

As best seen in FIG. 2, the vertical support 40 further includes an anchor assembly 70 integral with top end 45. The anchor assembly 70 includes a horizontal plate 75, which extends inwardly from the top end 45 of the vertical support 40 in a horizontal direction, and a vertical plate 80, which extends downwardly from the horizontal plate 75 plate along an inside surface 90 of vertical support 40. With further reference to FIG. 1, the two plates 75,80 form an inverted L-shape on the inside surface 90 of the top end 45 of vertical support 40. The plates 75,80 are preferably made of a strong durable material such as steel or aluminum.

Figure 3:
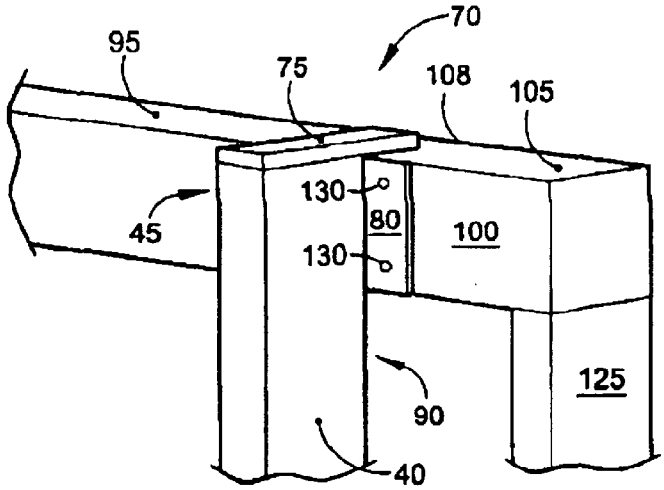
FIG. 3 is a perspective view of the anchor assembly of FIG. 2 attached to a crossbeam of a building under construction according to the present invention.
Figure 6:
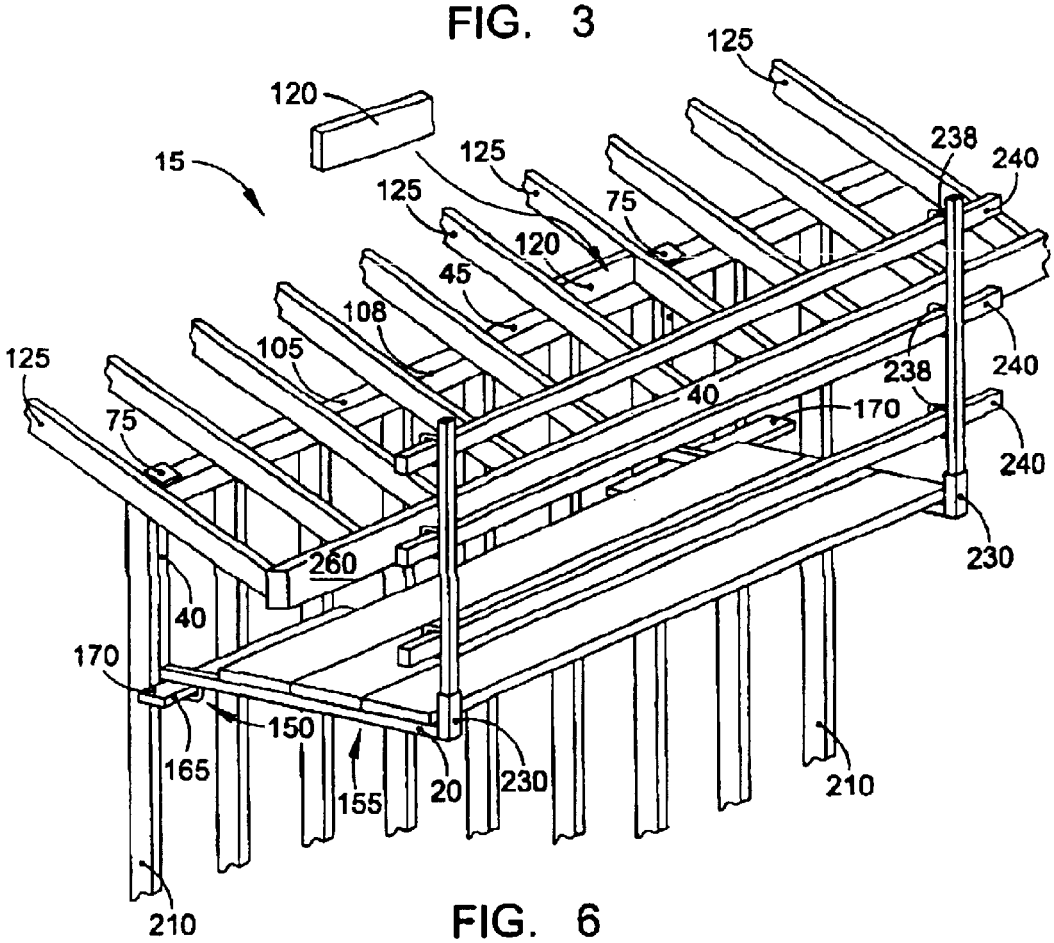
FIG. 6 is a perspective view of an exemplary embodiment of an assembled suspended scaffolding system for a building under construction according to the present invention.

As seen in FIGS. 3 and 6, the anchor assembly 70 is structured to be wrapped underneath and atop a crossbeam 95, which may be a solid beam or a pair of stacked 2×4s. During use of the scaffolding system, the anchor assembly 70 is positioned so that the vertical plate 80 is in contact with an inside surface 100 of the crossbeam 95 and the horizontal plate 75 is in contact with a portion of the top surface 105 of crossbeam 95. Importantly, a leading edge 108 of the top surface 105 of crossbeam 95 is unobstructed by the scaffolding bracket 10 and, therefore, remains accessible so that certain jobs can be completed without removing the bracket 10. For example, as best seen in FIG. 6, freeze blocks 120 are typically installed in contact with the leading edge 108 of the crossbeam 95 in between roofing rafters 125. Since anchor assembly 70 wraps around the crossbeam 95 and permits access to the leading edge 108, installation of the freeze blocks 120 may be conveniently accomplished without removing the brackets 10.

As best seen in FIG. 2, the vertical plate 80 of the anchor assembly 70 includes a plurality of apertures 130 structured to receive fasteners 135 such as nails, bolts, rivets or screws, for further securing the anchor assembly 70 to a crossbeam 95 after the initial fitting. The primary function of fasteners 135 is to prevent the brackets 10 from shifting after installation.

Figure 4:
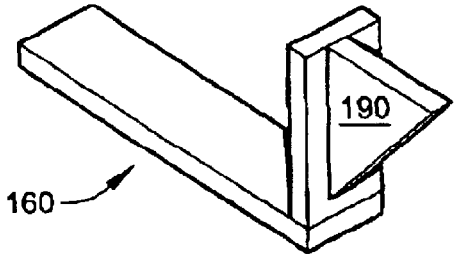
FIG. 4 is a perspective view of a first exemplary embodiment of a brace for a suspended scaffolding bracket according to the present invention.
Figure 5:
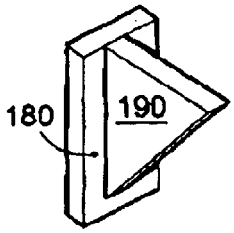
FIG. 5 is a perspective view of a second exemplary embodiment of a brace for a suspended scaffolding bracket according to the present invention.

As seen in FIGS. 1, 4 and 5, the suspended scaffolding bracket 10 also includes a brace 150 attached to a lower side 155 of the horizontal support 20. With reference to FIG. 4, in a first exemplary embodiment, the brace 150 is an L-shaped brace 160, whereby the L-shaped brace 160 and the lower side 155 of the horizontal support 20 form a U-shaped opening for receiving a side edge 165 of a cross-support 170 such as a 2×4. With reference to FIG. 5, in a second exemplary embodiment, the brace 150 is a horizontal plate 180, which forms an abutment for a flat side 185 of cross-support 170. In either exemplary embodiment, the brace 150 may further include an angled support 190 for added stability and a mounting plate (not shown) for attachment to the horizontal support 20. Preferably, the brace 150 is made of a strong durable material such as steel or aluminum and may be affixed to the horizontal support 20 by welding or using fasteners (not shown) such as bolts, rivets or screws.

As weight is applied to the horizontal support 20 of the scaffolding bracket 10 in the form of workers and equipment, the resulting stresses are offset by the cross-support 170, which distributes the stresses across a plurality of studs 210. To achieve proper stress distribution, the cross-support 170 is dimensioned to span at least three studs 210 of the building 15. Conveniently, the vertical support 40 is positioned inside of and approximately parallel to a stud 210 so as to not impede on the workspace of the construction workers.

As seen in FIGS. 1 and 6, a railing system 220 is mounted near the second end 30 of horizontal support 20. The railing system 220 includes a safety post receiver 230, which is a hollow tube structured to releasably receive a safety post 235. The safety post 235 includes a plurality of vertically spaced channels 238 designed to receive horizontal safety rails 240. As best seen in FIG. 1, a quick release pin 245 is provided on the safety post and a corresponding opening 248 is provided on the safety post receiver 230 to facilitate assembly and disassembly of the railing system 220.

An exemplary embodiment of a suspended scaffolding system using a plurality of scaffolding brackets 10 according to the present invention will now be described. As seen in FIGS. 1 and 6, the scaffolding system includes a pair of scaffolding brackets 10, each including a horizontal support 20, a vertical support 40, an anchor assembly 70 for attachment to a crossbeam 95, a brace 150 for receiving a cross-support 170, and a railing assembly 220. The scaffolding system further includes a plurality of scaffolding planks 250 spanning the pair of scaffolding brackets 10 to form a walkway for the workers.

With further reference to FIG. 6, the scaffolding system is particularly useful in connection with roofing jobs. The square tubing of the scaffolding brackets 10 is strong enough to safely design a horizontal support 20 that is approximately 4 feet in length. A horizontal support 20 of this length provides ample working room between the fascia board 260 and the railing assembly 220. An additional advantage of the scaffolding brackets 10 is that each anchor assembly 70 is dimensioned to be fitted underneath and atop crossbeam 95 so that the leading edge 108 of the top surface 105 of crossbeam 95 is not blocked by the horizontal plate 75. This is an important feature since most roofing projects cannot be completed if the leading edge 108 is blocked. For example, typical roofing projects require freeze blocks 120 to be installed in contact with the leading edge 108 of the crossbeam 95 in between roofing rafters 125. Since the anchor assembly 70 wraps around the crossbeam 95 and permits access to the leading edge, installation of the freeze blocks 120 may be conveniently accomplished without removing the brackets 10.

A method of installing a suspended scaffolding system around a building under construction according to an exemplary embodiment of the present invention will now be described. With further reference to FIGS. 1 and 6, The method begins with the step of providing a plurality of scaffolding brackets 10 according to one of the previously described embodiments. Next, each of the scaffolding brackets 10 is maneuvered so that the anchor assembly 70 is positioned across the inside 100 and top surfaces 105 of a crossbeam 95 of the building 15 under construction. The maneuvering step is accomplished by lifting each scaffolding bracket 10 and positioning the anchor assembly 70 around the inside surface 100 of the crossbeam 95. Maneuvering each bracket in this manner achieves the goal of positioning each scaffolding bracket 10 such that construction work along the leading edge 120 of the crossbeam 95 can be completed without removing the scaffolding bracket 10.

After maneuvering the anchor assembly 70 into position about the crossbeam 95, the next step consists of lifting the second end 30 of horizontal support 20 up just a few inches and positioning a side edge 165 of the cross-support 170 into the U-shaped opening formed by the L-shaped brace 160 and the bottom surface 155 of the horizontal support 20. However, if the brace 150 is a horizontal plate 180, the step consists of lifting the second end 30 of horizontal support 20 and positioning a flat side 185 of the cross-support 170 against the horizontal plate 180. In either case, the cross-support 170 should be positioned between the brace 150 and the studs 210 of the building 15 such that the cross-support 170 spans at least three studs 210. The final step consists of laying scaffolding planks 250 across the horizontal supports 20 of the scaffolding brackets 10 to form a walkway.

An additional step may include securing each scaffolding bracket 10 to the crossbeam 95 with fasteners 135 extending through the plurality of apertures 130 in vertical plate 80. A further step may include assembling the railing system 220 by slipping the safety post 235 into the safety post receiver 230 and slipping horizontal safety rails 240 through the vertically spaced channels 238.

The description and examples set forth in this specification and associated drawings set forth preferred embodiment (s) and some of the possible variations of the present invention. The specification and drawings are not intended to limit the exclusionary scope of this patent document. Many designs other than the above-described embodiments will fall within the literal and/or legal scope of the following claims. Because it is generally impossible for a patent to describe in its specification every conceivable and possible future embodiment of the invention, the exclusionary scope of this patent document should not be limited by features: (1) reflected in the specification and drawings, but (2) not explicated or reasonably implicated by the language of the following claims.

What is claimed is:

1. A suspended scaffolding bracket for a building under construction having one or more studs and crossbeams, the scaffolding bracket comprising:

a horizontal support having a first end and a second end;

a vertical support having a top end and a bottom end, wherein the bottom end is attached to the first end of the horizontal support; and an anchor assembly attached to the top end of the vertical support, the anchor assembly comprising a vertical plate, and a horizontal plate that is attached to an upper edge of the top end of the vertical support, such that the horizontal plate extends from and overhangs the upper edge of the vertical support toward the second end of the horizontal support.

2. The suspended scaffolding bracket of claim 1, wherein the horizontal plate is adapted to make contact with a top surface of a crossbeam.

3. The suspended scaffolding bracket of claim 1, wherein the vertical plate is adapted to make contact with an inside surface of a crossbeam.

4. The suspended scaffolding bracket of claim 1, further comprising a brace coupled to a bottom surface of the horizontal support, the brace being adapted to receive a cross-support.

5. The suspended scaffolding bracket of claim 4, wherein the brace is L-shaped.

6. The suspended scaffolding bracket of claim 4, wherein the brace includes a vertical plate forming an abutment for the cross-support.

7. The suspended scaffolding bracket of claim 1, wherein the vertical support is adapted to be positioned inside of and approximately parallel to a stud of the building under construction.

8. The suspended scaffolding bracket of claim 1, further comprising a vertical safety post having a top end and a bottom end, wherein the bottom end is attached to the second end of the horizontal support, such that the horizontal plate extends from the upper edge of the vertical support toward the vertical safety post.

9. The suspended scaffolding bracket of claim 1, wherein the horizontal plate is adapted to extend across a top surface of a crossbeam.

10. The suspended scaffolding bracket of claim 1, wherein the horizontal plate is adapted to extend across only a portion of a top surface of a crossbeam so that a leading edge of the top surface of the crossbeam is unobstructed and work adjacent to the leading edge can be completed without removing the bracket.

11. The suspended scaffolding bracket of claim 1, wherein the horizontal plate is adapted to extend across only a portion of a top surface of a crossbeam so that a leading edge of the top surface of the crossbeam is unobstructed and a freeze block can be installed in contact with the leading edge without removing the bracket.

12. A suspended scaffolding bracket for a building under construction having one or more studs and crossbeams, the scaffolding bracket comprising:

a horizontal support having a first end and a second end;

a vertical support having a top end and a bottom end, wherein the bottom end is attached to the first end of the horizontal support; and a substantially T-shaped anchor assembly attached to the top end of the vertical support, the T-shaped anchor assembly comprising a vertical plate and a horizontal plate that is attached to an upper edge of the top end of the vertical support, such that the horizontal plate extends from and overhangs the upper edge of the vertical support toward the second end of the horizontal support.

13. The suspended scaffolding bracket of claim 12, wherein the horizontal and vertical plates are adapted to make contact with top and inside surfaces, respectively, of a crossbeam of the building such that construction work adjacent the crossbeam can be completed without removing the scaffolding bracket.

14. The suspended scaffolding bracket of claim 13, wherein the horizontal plate is adapted to make contact with only a portion of the top surface of the crossbeam.

15. The suspended scaffolding bracket of claim 13, wherein the vertical plate includes a plurality of apertures structured to receive fasteners for releasably securing the anchor assembly to the crossbeam.

16. The suspended scaffolding bracket of claim 13, wherein the horizontal plate is adapted to extend across only a portion of the top surface of the crossbeam so that a leading edge of the top surface of the crossbeam is unobstructed and work adjacent to the leading edge can be completed without removing the bracket.

17. The suspended scaffolding bracket of claim 13, wherein the horizontal plate is adapted to extend across only a portion of the top surface of the crossbeam so that a leading edge of the top surface of the crossbeam is unobstructed and a freeze block can be installed in contact with the leading edge without removing the bracket.

18. The suspended scaffolding bracket of claim 12, further comprising a brace coupled to a bottom surface of the horizontal support, the brace being adapted to receive a cross-support.

19. The suspended scaffolding bracket of claim 18, wherein the brace is L-shaped.

20. The suspended scaffolding bracket of claim 18, wherein the brace includes a vertical plate forming an abutment for the cross-support.

21. The suspended scaffolding bracket of claim 12, wherein the vertical support is adapted to be positioned inside of and approximately parallel to a stud of the building under construction.

* * * * *